US006372366B1

(12) United States Patent
Yoneda

(10) Patent No.: US 6,372,366 B1
(45) Date of Patent: Apr. 16, 2002

(54) ELECTROLUMINESCENT ELEMENT

(75) Inventor: Koji Yoneda, Ichikawa (JP)

(73) Assignee: Seiko Precision, Inc., Tokyo (JP)

( * ) Notice: Subject to any disclaimer, the term of this patent is extended or adjusted under 35 U.S.C. 154(b) by 0 days.

(21) Appl. No.: 09/267,812

(22) Filed: Mar. 12, 1999

(30) Foreign Application Priority Data

Mar. 13, 1998 (JP) ..... 10-061811

(51) Int. Cl.[7] ..... H05B 33/00

(52) U.S. Cl. ..... 428/690; 313/506; 313/509; 313/511; 313/512

(58) Field of Search ..... 428/690, 917; 313/506, 511, 512, 509

(56) References Cited

U.S. PATENT DOCUMENTS 5,276,382 A * 1/1994 Stocker et al. ..... 313/506
5,309,060 A * 5/1994 Sharpless et al. ..... 313/511
5,976,613 A * 11/1999 Janusauskas ..... 427/66

FOREIGN PATENT DOCUMENTS

| | | |
|---|---|---|
| EP | 981 267 | 2/2000 |
| JP | 1-66790 | 4/1989 |
| JP | 5-290971 A | 11/1993 |
| JP | 5-347185 A | 12/1993 |
| JP | 9-115670 A | 5/1997 |
| JP | 11 260565 | 9/1999 |

OTHER PUBLICATIONS

JP 9–115670—Translation of Abstract of Japanese Publication.
JP 5–290971—Translation of Abstract of Japanese Publication.
JP 5–347185—Translation of Abstract of Japanese Publication.
JP 1–66790—Translation of Abstract of Japanese Publication.

* cited by examiner

*Primary Examiner*—Cynthia H. Kelly
*Assistant Examiner*—Dawn Garrett
(74) *Attorney, Agent, or Firm*—Schulte Roth & Zabel; Donna Angotti; Joel Lutzker

(57) ABSTRACT

In an electroluminescent element having at least two light-emitting parts, the electric interconnection is ensured in the part in which the light-emitting parts are connected, and the electric short-circuiting in that part is prevented. In the electroluminescent element comprising a light-emitting part A and a light-emitting part B, a flexible, insulating resin layer 5 is provided in the connecting part C in which the two parts A and B are connected. In this, the transparent electrode 2 and the back electrode 6 in the connecting part C are prevented from being cracked owing to the layer 5 existing in the part C. As the means for compensating the electric interconnection between the light-emitting parts in the device, provided are a transparent electrode leading part 9 and a back electrode leading part 10 both of resin binder-containing ink layers.

2 Claims, 3 Drawing Sheets

ELECTROLUMINESCENT ELEMENT

BACKGROUND OF THE INVENTION

1. Field of the Invention

The present invention relates to an electroluminescent element.

2. Description of the Related Art

Having a thickness of smaller than 1 mm, an electroluminescent element has many applications as a thin, power-saving light emitter. With the recent boom in mobiles, such as typically portable telephones being much popularized, an electroluminescent element is indispensable to the backlight in many portable electronic appliances. When an electroluminescent element is used for the backlight in such portable electronic appliances, its shape is naturally determined depending on the shape of the display part of the electronic appliances.

For example, when an electroluminescent element is employed for the backlight in portable telephones, it shall be composed of two light-emitting parts A and B that individually lighten the body part provided with key switches and the liquid-crystal display part for displaying telephone numbers and other informations in its window. In the electroluminescent element with that constitution, the transparent electrode film layer, the insulating layer and the back electrode layer are integrated for the two light-emitting parts.

In one example, a transparent electrode layer 42 of ITO is formed on the back surface of a transparent electrode filmlayer 41, and light-emitting layers 43, 43, which are for the region of the switch key part and for the region of the display part, respectively, are formed on the back surface of the transparent electrode layer 42, as in FIG. 4. In this, however, no light-emitting layer is provided in the throat part C, and an insulating layer 44 is provided over the both light-emitting parts A and B so as to separate them from each other. On the back surface of the insulating layer 44, formed is a back electrode layer 46, and the two light-emitting parts 43, 43 are electrically connected by the back electrode layer 46 and the transparent electrode layer 42. On the back surface of the back electrode layer 46, formed is a protective layer 47 of polyester or the like.

As having a small area, the throat part C may receive stress concentration when bent, whereby the layer of ITO, the insulating layer and the back electrode layer that are made of brittle materials are often cracked. The cracks cause electric interconnection failure in the electrode layers and insulation failure in the insulating layer, whereby the device is short-circuited.

SUMMARY OF THE INVENTION

The invention is to solve the problems noted above, and provides an electroluminescent element having at least two light-emitting parts, in which the transparent electrode leading part and the back electrode leading part that are to electrically connect the transparent electrode and the back electrode for the light-emitting parts are made of resin binder-containing conductive ink layers of materials that hardly crack against bending force.

In the electroluminescent element of the invention, the transparent electrode leading part is formed on the transparent electrode, and a flexible, insulating resin layer is formed between the back electrode leading part and the transparent electrode above which the back electrode leading part is formed, whereby the deformation resistance of the electroluminescent element is enlarged and the cracking and the electric short-circuiting to be caused by bending force could be prevented.

DETAILED DESCRIPTION OF THE INVENTION

The electroluminescent element of the invention has at least two light-emitting parts, comprising a light-emitting layer, a dielectric layer and a back electrode as laminated in that order on a transparent electrode formed on a transparent electrode base film. In this, the transparent electrode and the back electrode for the light-emitting parts are electrically connected by the transparent electrode leading part and the back electrode leading part, respectively; the back electrode, the transparent electrode leading part and the back electrode leading part are of resin binder-containing conductive ink layers; the transparent electrode leading part is formed on the transparent electrode; and a flexible, insulating resin layer is formed between the back electrode leading part and the transparent electrode above which the back electrode leading part is formed.

As the insulating resin, preferred is a polyester resin or a polyvinyl resin.

DESCRIPTION OF THE PREFERRED EMBODIMENTS

Figure 1:
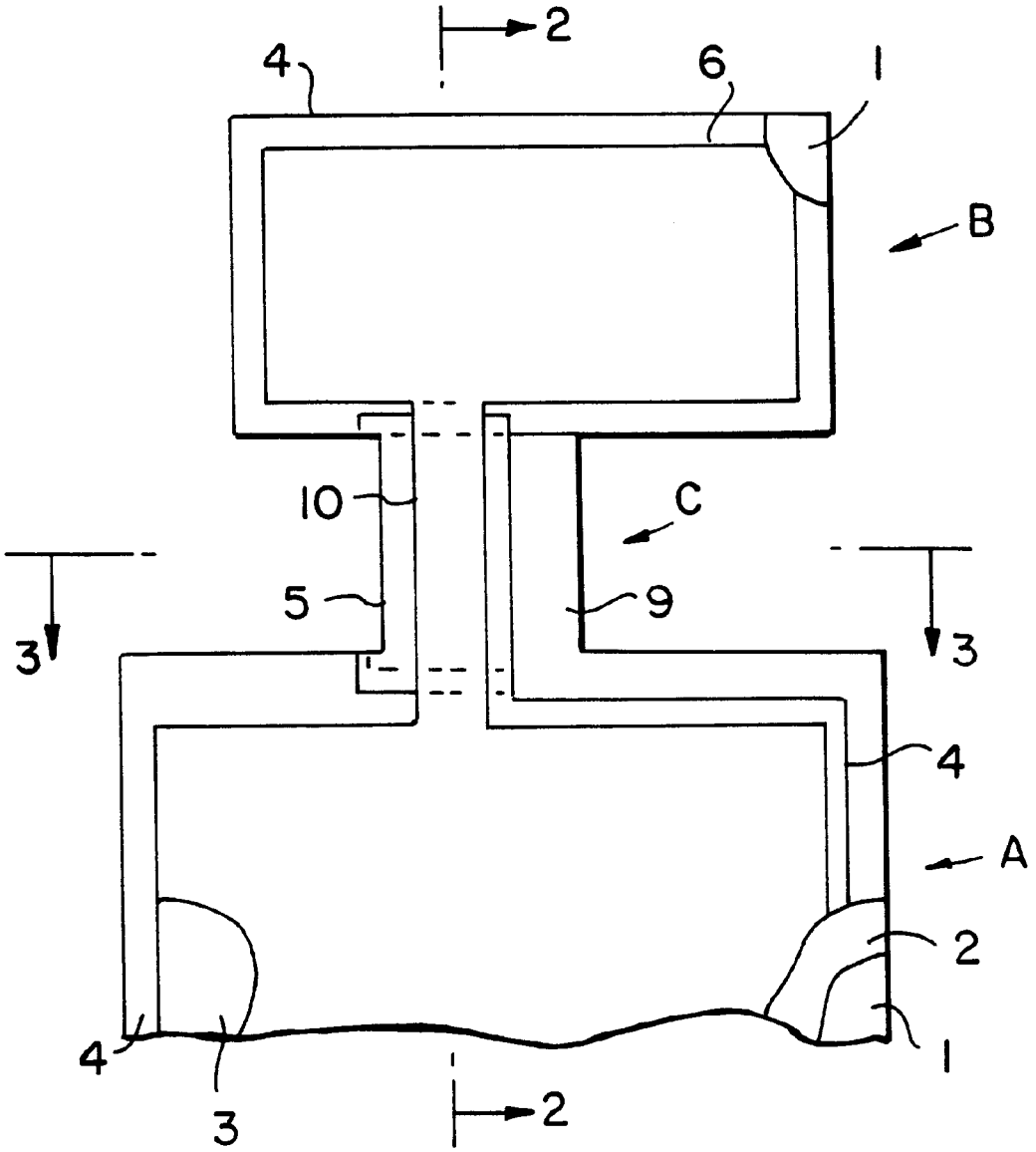
FIG. 1 is a schematic back view of one embodiment of the electroluminescent element of the invention, in which the protective layer is not shown.

As in FIG. 1, the electroluminescent element for portable telephones comprises a first light-emitting part A that is to be the backlight for key switches and a second right-emitting part B that is to be the backlight for the liquid-crystal display part for displaying letters and other informations in its window.

The first light-emitting part A is electrically connected with a circuit board (not shown) on which are mounted portable telephone driving circuits, and it could be switched on and off by the key switch operation. On the other hand, the second light-emitting part B that is to be the backlight for the liquid-crystal display part is electrically connected with the transparent electrode and the back electrode in the first light-emitting part A via a connecting part C, and it could be switched on and off in accordance with the on/off operation for the light-emitting part A.

Figure 2:
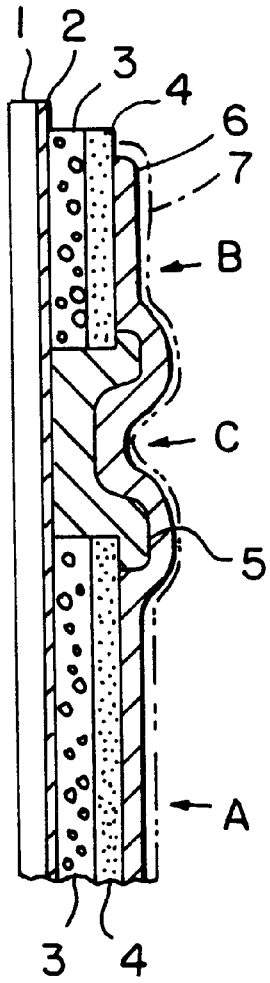
FIG. 2 is a cross-sectional view of FIG. 1, as cut along the 2—2 line.

FIG. 2 is a cross-sectional view schematically showing the constitution of the electroluminescent element. As in FIG. 2, the transparent electrode base film 1 is provided to be common to the entire surface of the two light-emitting parts A and B and the connecting part C, and the transparent electrode 2 is formed on the back surface (right side in FIG. 2) of the base film 1. The transparent electrode base film 1 is a transparent film of polyethylene terephthalate (PET), and the transparent electrode 2 is formed through vapor deposition on one surface of the transparent electrode base film.

On the surface of the transparent electrode 2 formed on the transparent electrode base film 1, formed are light-emitting layers 3, 3 for the regions of the first light-emitting part A and the second light-emitting part B. The light-emitting layers 3, 3 are formed, for example, through screen-printing with a printing ink as prepared by kneading a light-emitting material of copper-doped zinc sulfide (Cu—ZnS) and a binder.

On the back surface (right side in FIG. 2) of the light-emitting layers 3, 3, formed are dielectric layers 4, 4. The dielectric layers 4, 4 are formed, for example, through printing with an ink as prepared by mixing and kneading a high dielectric substance such as barium titanate ($BaTiO_3$) or the like and a binder.

Between the light-emitting layers 3, 3 and the dielecric layers 4, 4 thereon, formed is a flexible, insulating resin layer 5 in the region of the connecting part C having neither the light-emitting layer nor the dielectric layer thereon. The insulating resin layer 5 is so formed that it extends from the connecting part C to the neighboring light-emitting parts A and B and overlaps with the parts A and B. With that constitution, the layered structure can bear any large bending force that may be applied to the boundaries between the part C and the parts A and B.

As the material for the insulating resin layer 5, employed is a polyester resin or a polyvinyl resin. Concretely, for example, the layer 5 may be formed through printing with an ink dispersion as prepared by mixing and kneading and dispensing an organic pigment-containing polyester resin and a silicone-based defoaming agent along with a solvent.

As comprising such a polyester resin or a polyvinyl resin and being flexible, the insulating resin layer 5 can bear any large bending stress on the connecting part C. In addition, since the insulating resin of the layer 5 is well compatible with ITO that forms the transparent electrode 2, the layer 5 is not peeled away from the transparent electrode 2 at the boundary therebetween even when the device is bent at the connecting part C. In that manner, the insulating resin layer 5 is effective for stabilizing the quality of the EL device.

On the back surface (right side in FIG. 2) of the dielectric layers 4, 4 and the insulating resin layer 5, formed is the back electrode 6. The back electrode 6 is formed through printing with an ink dispersion as prepared by mixing and kneading a carbon graphite powder, a binder and a polyester resin along with an isophorone solvent. On the back surface of the back electrode 6, formed is a protective film 7 of a thin film of a polyester resin.

Figure 3:
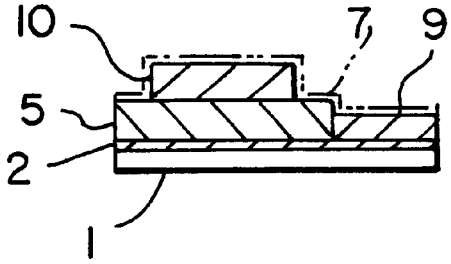
FIG. 3 is a cross-sectional view of FIG. 1, as cut along the 3—3 line.
Figure 4:
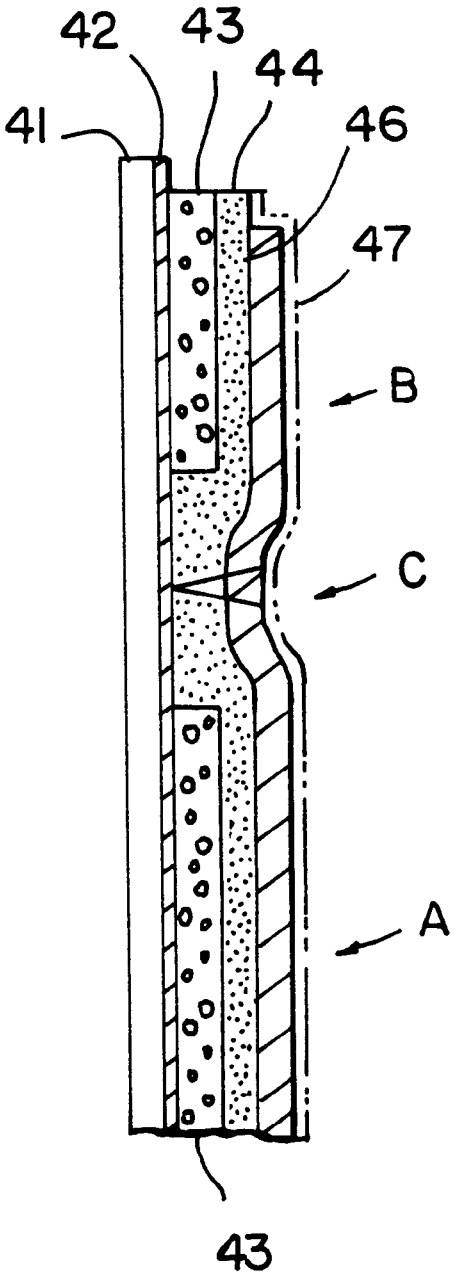
FIG. 4 is a cross-sectional view showing one example of a conventional electroluminescent element.

The structure of the connecting part C is described, for which referred to is FIG. 3 that shows the cross section of the connecting part C. As illustrated, the flexible, insulating resin layer S is laminated on the surface of the transparent electrode 2 formed on the transparent electrode base film 1, in the area of about ⅔ of the width of the transparent electrode base film 1.

In the remaining area of about ⅓ of the width of the transparent electrode base film 1, formed is the transparent electrode leading part 9 of a resin binder-containing conductive ink layer. The transparent electrode leading part 9 is so formed that the part thereof at the edge in the right side in the first light-emitting part A is integrated with the part thereof in the connecting part C on the upper surface of the transparent electrode 2, and this is connected with the transparent electrode in the second light-emitting part B (see FIG. 1).

On the upper surface of the flexible, insulating resin layer 5, formed is the back electrode leading part 10 of a resin binder-containing conductive ink layer. The back electrode leading part 10 is to connect the back electrode in the first light-emitting part A and the back electrode in the second light-emitting part B in a different route. Of the connecting part C, the area of which the upper surface is exposed out is covered with the back surface-protecting layer 7 that is common to the two light-emitting parts A and B.

The ink in the resin binder-containing conductive ink layer for the transparent electrode leading part 9 and the back electrode leading part 10 is the same as that in the back electrode 6.

For the transparent electrode leading part 9, a carbon layer resistant to deformation is formed on the transparent electrode 2 in the first light-emitting part A at the edge in the right side, and the carbon layer passes through the connecting part C and is connected with the transparent electrode in the second light-emitting part B. With that constitution, the transparent electrode is hardly cracked in the connecting part C, and ensures the light emission in the light-emitting part B.

The description of the electroluminescent element of the invention is herein made for the backlight for portable telephones. Without being limited to this, the electroluminescent element of the invention is applicable to the backlight for other electronic appliances and to various lighting means.

As has been described in detail hereinabove, the back electrode, the back electrode leading part and the transparent electrode leading part in the electroluminescent element of the invention are all of resin binder-containing conductive ink layers. In the electroluminescent element, therefore, the transparent electrode and the back electrode are hardly cracked or broken, and, in addition, their electric connection in plural light-emitting operation in one light-emitting region ensures the light emission in the other light-emitting regions.

In addition, in the electroluminescent element, the part of the dielectric layer which may be peeled off from the transparent electrode or may be cracked when it receives large bending stress is substituted with a flexible, insulating resin layer. Therefore, the electroluminescent element is neither cracked nor broken in any part and is free from electric interconnection failure or electric short-circuiting.

While the invention has been described in detail and with reference to specific embodiments thereof, it will be apparent to one skilled in the art that various changes and modifications can be made therein without departing from the spirit and scope thereof.

What is claimed is:

1. An electro luminescent element comprising:

at least two light-emitting parts, each said light-emitting part having a light-emitting layer, a dielectric layer and a back electrode laminated in that order on a transparent electrode, said transparent electrode formed on a transparent electrode base film;

said transparent electrode and said back electrode in each said light-emitting part are electrically connected by a transparent electrode leading part and a back electrode leading part respectively;

said back electrode, said transparent electrode leading part and said back electrode leading parts are all of resin binder-containing conductive ink layers;

said transparent electrode leading part is formed on said transparent electrode; and a flexible, insulating resin layer is formed between said back electrode leading part and said transparent electrode above which said back electrode-leading part is formed.

2. The electroluminescent element as claimed in claim 1, wherein said insulating resin is a polyester resin or a polyvinyl resin.

* * * * *